US008354988B2

(12) United States Patent
Kim et al.

(10) Patent No.: US 8,354,988 B2
(45) Date of Patent: Jan. 15, 2013

(54) LIQUID CRYSTAL DISPLAY DEVICE AND METHOD FOR DRIVING THE SAME

(75) Inventors: Jin Sung Kim, Gyeongsangbuk-do (KR); Dong Hoon Cha, Gyeongsangbuk-do (KR); Ha Young Ji, Gyeongsangbuk-do (KR); Min Ki Kim, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 646 days.

(21) Appl. No.: 12/314,807

(22) Filed: Dec. 17, 2008

(65) Prior Publication Data

US 2010/0053059 A1 Mar. 4, 2010

(30) Foreign Application Priority Data

Sep. 4, 2008 (KR) ..... 10-2008-0087156

(51) Int. Cl.
*G09G 3/36* (2006.01)

(52) U.S. Cl. ..... 345/99; 345/88; 345/89; 345/96; 345/100; 345/204; 345/209; 345/690

(58) Field of Classification Search ..... 345/87–100, 345/204, 208–210
See application file for complete search history.

(56) References Cited

U.S. PATENT DOCUMENTS

| | | | | |
|---|---|---|---|---|
| 2002/0024482 | A1* | 2/2002 | Song et al. | 345/87 |
| 2004/0263448 | A1* | 12/2004 | Baek et al. | 345/87 |
| 2007/0097054 | A1* | 5/2007 | Cheng | 345/96 |
| 2007/0165256 | A1* | 7/2007 | Cho et al. | 358/1.9 |
| 2007/0296680 | A1* | 12/2007 | Lee et al. | 345/100 |
| 2008/0079678 | A1* | 4/2008 | Cho et al. | 345/88 |
| 2008/0122874 | A1* | 5/2008 | Han et al. | 345/690 |
| 2009/0102997 | A1* | 4/2009 | Wen et al. | 349/54 |

* cited by examiner

*Primary Examiner* — Lun-Yi Lao
*Assistant Examiner* — MD Saiful A Siddiqui
(74) *Attorney, Agent, or Firm* — Morgan, Lewis & Bockius LLP

(57) ABSTRACT

The liquid crystal display device includes a liquid crystal display panel including first sub-pixels for charging a data of a polarity opposite to a prior horizontal period, and second sub-pixels for charging a data of a polarity identical to a prior horizontal period; a data driver for driving a plurality of data lines of the liquid crystal display panel; and a timing controller for dividing a charging period of the data into a plurality of charging periods, generating at least one compensation data for compensating a data on at least one of the plurality of charging periods, and supplying the at least one compensation data to the data driver.

11 Claims, 8 Drawing Sheets

LIQUID CRYSTAL DISPLAY DEVICE AND METHOD FOR DRIVING THE SAME

This application claims the benefit of the Patent Korean Application No. P2008-087156, filed on Sep. 4, 2008, which is hereby incorporated by reference as if fully set forth herein.

BACKGROUND OF THE INVENTION

1. Field of the Invention

The present invention relates to a liquid crystal display device and a method for driving the same, in which a difference of data charge quantities is compensated in a liquid crystal display panel having a reduced number of data lines, for reducing power consumption.

2. Discussion of the Related Art

The liquid crystal display device displays a picture by using electric and optical characteristics of liquid crystals. The liquid crystal has an anisotropic characteristic in which both refractive indices and dielectrics in a long axis direction and a short axis direction of a molecule thereof are different from each other. The liquid crystal display device which utilizes those characteristic displays the picture by varying alignment direction of the liquid crystal molecules according to intensity of an electric field, thereby controlling a light transmissivity of a polarization plate.

The liquid crystal display device is provided with a liquid crystal display panel having a matrix of pixels, a gate driver for driving gate lines of the liquid crystal display panel, and a data driver for driving data lines of the liquid crystal display panel.

Each of the pixels on the liquid crystal display panel produces a desired color with a combination of red, green, blue sub-pixels which control the light transmissivities thereof in response to a data signal. Each of the sub-pixels is provided with a thin film transistor connected to the gate line and the data line, and a liquid crystal capacitor connected to the thin film transistor. The liquid crystal capacitor has a charge of a voltage difference between a data signal supplied to a pixel electrode through the thin film transistor and a common voltage supplied to a common electrode, and drives the liquid crystals according to the voltage charged thus for controlling the light transmissivity.

The gate driver has a plurality of gate integrated circuit (called as IC hereafter) for driving the gate lines of the liquid crystal display panel in succession.

The data driver has a plurality of data IC for converting a digital data signal into an analog data signal every time each of the gate lines is driven, and supplying the analog signal converted thus to the data lines of the liquid crystal display panel.

The data IC has complicate circuits, such as a digital-analog converter which costs high, and requires many data ICs more than the gate ICs since a number of the data lines are greater than a number of the gate lines in the liquid crystal display panel. Consequently, in order to reduce a production cost of the liquid crystal display device, a scheme has been taken into consideration, in which a number of the data ICs is reduced while a resolution of the liquid crystal display panel is maintained as it is.

For an example, in order to reduce a number of the data ICs, a liquid crystal display panel has been suggested, in which odd and even numbered sub-pixels positioned opposite sides of a data line are driven by the data line in succession for reducing a number of the data lines into one half.

However, in a case two dot inversion is applied for reducing power consumption of the liquid crystal display panel having a number of the data lines reduced by one half, a case can take place in which the sub-pixel is over charged due to a polarity thereof identical to a prior horizontal period and the sub-pixel is under charged due to a polarity thereof opposite to a prior horizontal period in longitudinal lines or transverse lines. In this case, a difference of data charge quantities takes place compared to the same gray scale between the overcharged pixel lines and the undercharged pixel lines, to cause a problem in which a poor picture quality, like longitudinal line or transverse line stains takes place. In order to solve the problem, a charge time period is reduced randomly in an overcharge period, i.e., data transition is made in the overcharge period to reduce the charge time period in the overcharge time period, so that the undercharge period and the overcharge period have an identical charge characteristic, as shown in FIG. 1. However, the random formation of a charge sharing section in the overcharge period causes to fail proper charge of the data, to cause to provide improper brightness. Moreover, the random formation of the transition sections in the overcharge time period leads to have more transition sections, which increases power consumption.

SUMMARY OF THE INVENTION

Accordingly, the present invention is directed to a liquid crystal display device and a method for driving the same.

An object of the present invention is to provide a liquid crystal display device and a method for driving the same, in which a difference of data charge quantities is compensated in a liquid crystal display panel having a reduced number of data lines, and which can reduce power consumption.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device includes a liquid crystal display panel including first sub-pixels for charging a data of a polarity opposite to a prior horizontal period, and second sub-pixels for charging a data of a polarity identical to a prior horizontal period, a data driver for driving a plurality of data lines of the liquid crystal display panel, and a timing controller for dividing a charging period of the data into a plurality of charging periods, generating at least one compensation data for compensating a data on at least one of the plurality of charging periods, and supplying the at least one compensation data to the data driver.

In another aspect of the present invention, a method for driving a liquid crystal display device includes the steps of dividing a data enable signal received from an outside into 1/2, dividing the 1/2 data enable signal into n/m (where m is a natural numeral greater than n) to generate n/m data enable signals in return, and dividing the charging time period of the data into a plurality of charging periods by using the n/m data enable signals, and generating at least one compensation data for compensating a data on at least one of the plurality of charging periods.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 2:
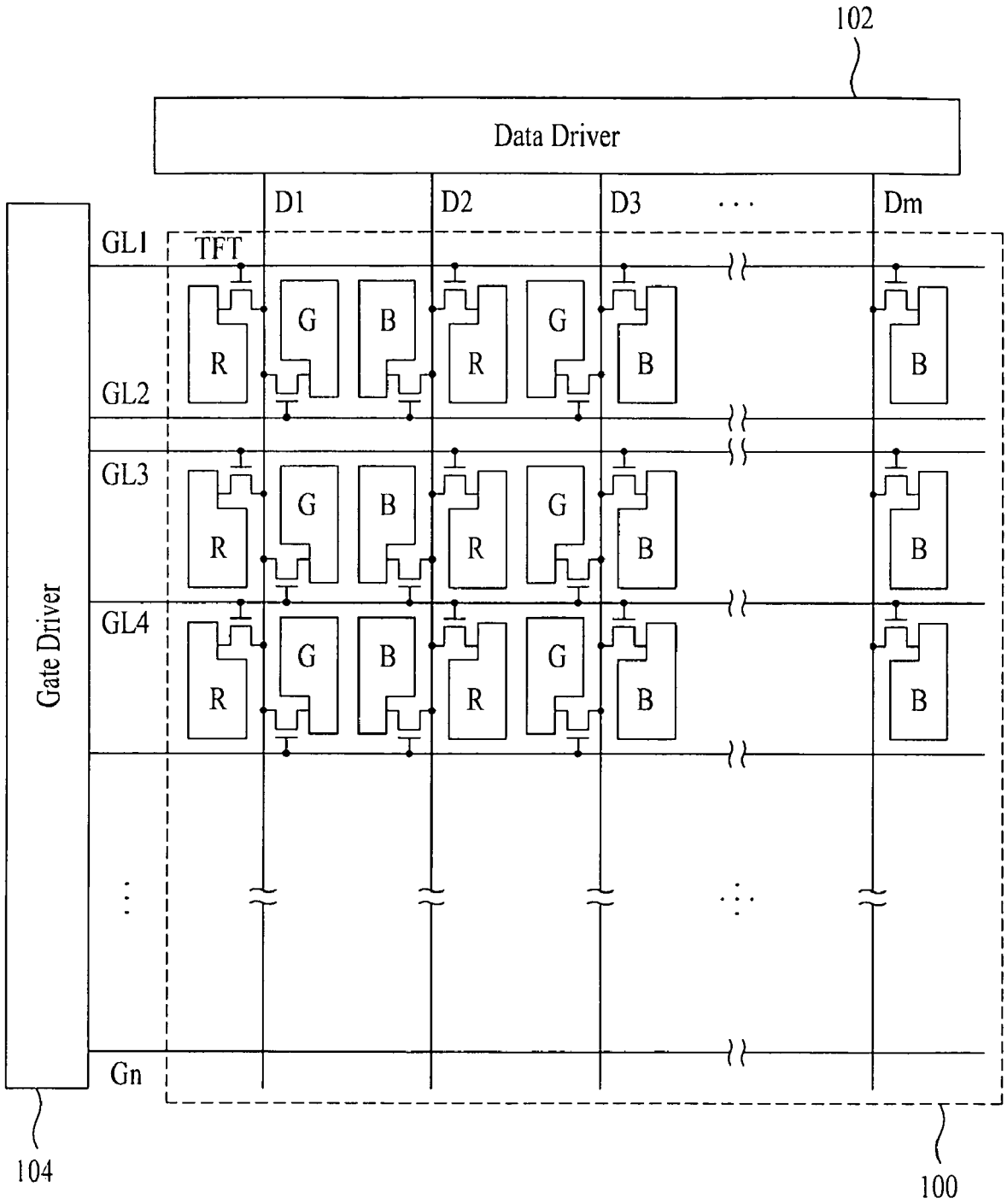
FIG. 2 illustrates a pixel matrix of a liquid crystal display panel of a liquid crystal display device in accordance with a preferred embodiment of the present invention.

FIG. 2 illustrates a pixel matrix of a liquid crystal display panel of a liquid crystal display device in accordance with a preferred embodiment of the present invention.

Referring to FIG. 2, the pixel matrix of a liquid crystal display panel 100 includes a plurality of gate lines G1~Gn and data lines D1~Dm crossing each other, a plurality of sub-pixels R, G, B on opposite sides of each of the data lines D1~Dm, and a thin film transistor TFT formed at every portion where the gate lines G1~Gn and data lines D1~Dm cross each other.

Each of a plurality of the pixels of the pixel matrix has red, green, and blue sub-pixels. The plurality of sub-pixels are arranged such that an order of red, green, and blue R, G, B pixels are repeated along a longitudinal direction of the pixel matrix, and sub-pixels of the same color are repeated along a transverse direction of the pixel matrix.

Each of the data lines D1~Dm is connected to the sub-pixels on odd numbered columns and the sub-pixels on even numbered columns positioned on opposite sides thereof in common. That is, each of the data lines D1~Dm is connected to the sub-pixels on odd numbered columns on a left side thereof adjacent thereto through respective thin film transistors TFTs, and the sub-pixels on even numbered columns on a right side thereof adjacent thereto through respective thin film transistors TFTs. The sub-pixels on odd numbered columns and the sub-pixels on even numbered columns connected to the different data line are connected to the same gate line G1~Gn through respective thin film transistors TFT for being driven in succession. The connection of two sub-pixels to one data line enables to reduce a number of data lines D1~Dm by one half, permitting to reduce a number of ICs which drive the data lines D1~Dm.

Referring to FIG. 2, the liquid crystal display panel 100 employs a two dot inversion in which a data polarity is inversed at every two dots in the longitudinal direction and the data polarity is inversed at every one dot in the transverse direction for reducing power consumption. According to this, one pair of sub-pixels connected to the same data line in each of the longitudinal lines charge data of the same polarity, and the other pair of sub-pixels adjacent in the longitudinal direction and the other pair of sub-pixels adjacent in the transverse direction charge data of a polarity opposite to the one pair of sub-pixels.

In this instance, the data signal supplied to each of the data lines D1~Dm maintains the same polarity during two horizontal periods (2H hereafter), inverting the data polarity at every 2H, the data signal has a 4H polarity inversion period. As the data polarity is inverted at each of the data lines D1~Dm, one pair of the sub-pixels connected to the same data line and driven in succession can be sorted as a sub-pixel of undercharging characteristic which charges a data of polarity opposite to a prior horizontal period and a sub-pixel of overcharging characteristic which charges a data of polarity the same with the prior horizontal period. That is, one pair of the sub-pixels connected to the same date line and driven in succession can be sorted as an undercharging sub-pixel having an undercharging period in which a data charge quantity is small compared to the same gray scale due to charge of the data of a polarity opposite to a prior horizontal period which makes relatively long data rise or fall time period, and an overcharging sub-pixel having an overcharging period in which a data charge quantity is great compared to the same gray scale due to charge of the data of a polarity identical to a prior horizontal period.

Thus, the one pair of sub-pixels connected to the same data line and driven in succession cause a brightness difference between the undercharging sub-pixel and the overcharging sub-pixel to make a transverse line phenomenon. According to this, in order to reduce a data charge quantity of the overcharging sub-pixel which charges a data of a polarity identical to a prior horizontal period resulting to have a great data charge quantity, random short data charge time period of the overcharging sub-pixel is made for preventing the transverse line and the longitudinal line phenomenon from taking place.

Figure 1:
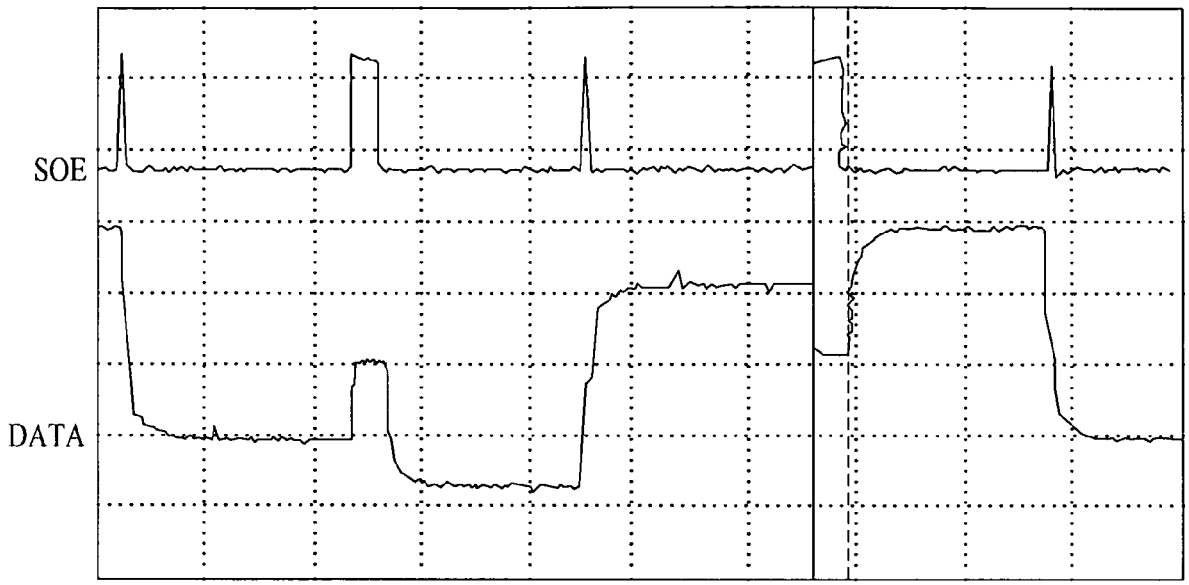
FIG. 1 Related Art
FIG. 1 illustrates driving waveforms in which random short charge time period is made in an overcharge time period.

However, the random short data charge time period in the overcharge time period as shown in a portion in FIG. 1 fails proper charge of the data, to fail to provide a desired brightness. That is, if it is intended to display a black color at the overcharging sub-pixel, it is likely that the overcharge sub-pixel display a gray color due to the random short data charge time period which leads to inadequate charge of the data.

In order to prevent this, the liquid crystal display device distributes an 1/2 data enable signal 1/2DE into n/m (where, m is a natural numeral greater than n) for compensating a section which is charge shared randomly in the overcharging period.

In detail, the 1/2 data enable signal 1/2DE is divided into a plurality of sections for adjusting a width of a data charge time period, enabling the data charge time period to divide into a plurality of sections. For an example, an 1/4 data enable signal 1/4DE is generated, having the 1/2 data enable signal 1/2DE divided by 1/2 once more, so that the data charge time period of 2 horizontal time period is divided into a first to fourth charge time period. According to this, as shown in FIG.

5, since the charge sharing time period is eliminated from the overcharging time period, an adequate charging time period can be secured.

That is, by securing a charging time period in the overcharging time period, enabling a proper charge of a data in the section, the brightness can be improved and the transverse line phenomenon can also be prevented. Thus, by securing an adequate charging time period in the overcharging time period, a CR (contrast ratio) can be improved. Moreover, by generating compensating data which can compensates the data of the first to fourth charging time period, each of the data can be modulated.

In the meantime, though the two times of charge sharing sections during two horizontal time periods in the related art causes four times of transition, to require great power consumption, the elimination of the two times of charge sharing sections by using the n/m compensation data unit in the liquid crystal display device of the present invention, to require only two times of transition of the data, enables to reduce the power consumption as much.

A table 1 below shows experimental values taking a model of an LP154WX5-TLA1 as an example, wherein a charge time period of 1 horizontal time period 1H by using the 1/2 data enable signal 1/2DE, and a charge time period of 1 horizontal time period 1H by using the 1/4 data enable signal 1/4DE are shown. Moreover, power consumptions are shown, when the 1/2 data enable signal 1/2DE and the 1/4 data enable signal 1/4DE are used, respectively. And, resultant values of comparison of the CR (Contrast Ratio) are shown taking a model of LP156WH-FPGA as an example.

TABLE 1

| Model | Item | ½ DE | ¼ DE | comparison |
|---|---|---|---|---|
| LP154WX5-TLA1 | 1H charging time | 5.5 μs | 7.1 μs | 1.6 μs increase |
| | Power reduction | 450 mA at Black | 380 mA at Black | About 9% reduction (50 mA at3.3 V) |
| LP156WH-FPGA | Contrast ratio | 142.7/0.45 = 317.1 | 142.7/0.40 = 356.75 | About 12.5% increase |

As can be noted in the table 1, in the overcharging time period in a DRD (Data Rate Driving) driving system, a data charging time period of 1.5 μs~2.0 μs can be secured, and as the charge sharing section is eliminated, the pixel power consumption is reduced by 8~10%. Moreover, it can be known that, by securing the data charging time period in the overcharging time period, the CR is increased by 12%~13%.

Figure 3:
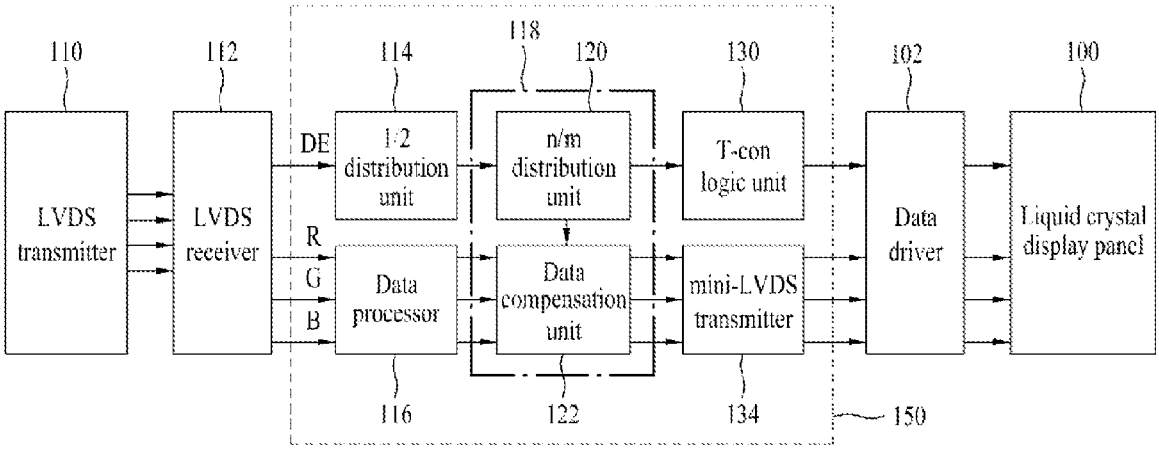
FIG. 3 illustrates a block diagram of a timing controller in a liquid crystal display device in accordance with a preferred embodiment of the present invention.
Figure 4:
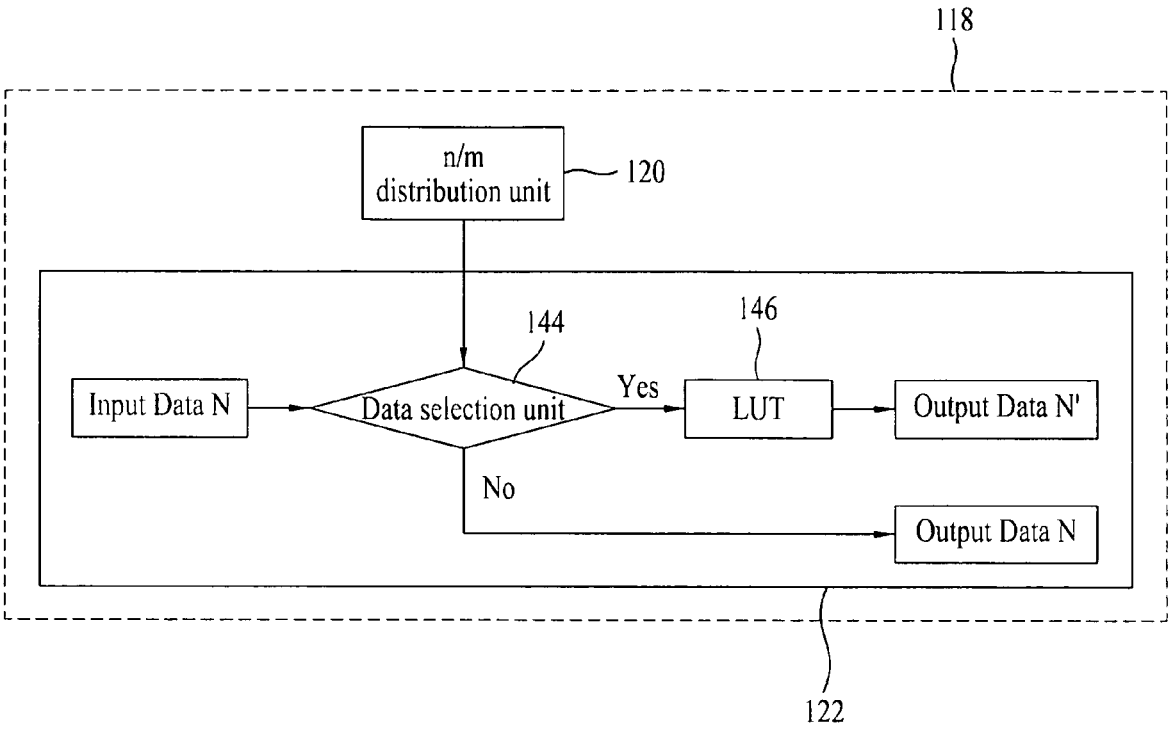
FIG. 4 illustrates a block diagram of the n/m compensation unit in FIG. 3 in detail.

FIG. 3 illustrates a block diagram of a timing controller in a liquid crystal display device in accordance with a preferred embodiment of the present invention, and FIG. 4 illustrates a block diagram of the n/m compensation unit in FIG. 3 in detail.

Referring to FIGS. 2 and 3, the liquid crystal display device includes an LVDS transmitter 110 and an LVDS receiver 112 for supplying the pixel data R, G, B and a plurality of synchronizing signals to a timing controller 150, the timing controller 150 for supplying a gate control signal GCS and a data control signal DCS, a data driver 102 for driving data lines D1~Dm in response to a data control signal DCS from the timing controller 150, and a gate driver 104 for driving gate lines G1~Gn in response to a gate control signal GCS from the timing controller 150.

Referring to FIG. 2, the liquid crystal display panel 100 has a pixel matrix having a number of the data lines D1~Dm reduced to one half.

The LVDS transmitter 110 supplies a pixel data R, G, B, a horizontal synchronizing signal H, a vertical synchronizing signal V, and so on to the LVDS receiver 112. In detail, the LVDS (Low Voltage Differential Signal) transmitter digitizes and compresses the pixel data R, G, B, the horizontal synchronizing signal H, the vertical synchronizing signal V, and so on, drops voltages thereof to a low voltage differential signal, and supplies to the LVDS receiver 112.

The LVDS receiver 112 restores the pixel data R, G, B, the plurality of synchronizing signals H, V by using voltage differences among the differential signals which are converted into an LVDS mode and supplied thereto, and outputs the signals restored thus.

The timing controller 150 aligns digital data from the LVDS transmitter 110 and the LVDS receiver 112 and outputs the digital data aligned thus to the data driver 102. The timing controller 150 also generates and supplies the data control signal DCS for controlling the data driver 102, and the gate control signal GCS for controlling the gate driver 104. A plurality of the data signals DCS include a source output enable signal SOE for controlling a data output time period of the data driver 102, a source start pulse SSP for indicating starting of data sampling, a source shift clock SSC for controlling data sampling timing, a polarity control signal for controlling a voltage polarity of a data, and so on. A plurality of the gate control signals GCS include a gate start pulse GSP for indicating starting of driving of the gate driver 104, a gate shift clock GSC for controlling a scan pulse output timing of the gate driver 104, a gate output enable signal GOE for controlling an output time period of the scan pulse, and so on.

The timing controller 150 generates an n/m data enable signal n/mDE for securing a charge time period in the overcharge time period in which the overcharge time period is made shorter randomly, compensates the data charge time period and the data, and outputs the data charge time period and the data compensated thus to the data driver 102. To do this, the timing controller 150 includes an 1/2 distribution unit 114, a data processor unit 116, an n/m compensation data unit 118, a timing-controller (T-con hereafter) logic unit 130, and a mini-LVDS transmitter 134.

Referring to FIGS. 3 and 4, the 1/2 distribution unit 114 distributes the data enable signal DE which indicates a data effective section from the LVDS transmitter 110 and the LVDS receiver 112 by 1/2 to generate an 1/2 data enable signal 1/2DE.

The data processor unit 116 aligns and outputs the digital data from the LVDS transmitter 110 and the LVDS receiver 112 to the data driver 102.

The n/m compensation unit 118 divides the 1/2 data enable signal 1/2DE from the 1/2 distribution unit 114 into n/m in return to compensate the data charge time period. That is, the n/m compensation unit 118 divides the 1/2 data enable signal 1/2DE from the 1/2 distribution unit 114 into, for an example, 1/2 once more, to generate the 1/4 data enable signal 1/4DE. Then, the n/m compensation unit 118 makes fine division of the data charge time period supplied in two horizontal periods to 1/4 by using the 1/4 data enable signal 1/4DE.

Thus, the data charging by making fine division of the data charging time period supplied in two horizontal periods to 1/4 permits to eliminate the charge sharing section, i.e., the data transition section, used for reducing the transverse line phenomenon in the overcharging time period ② in the related art. According to this, by elimination of the charge sharing section by using the n/m compensation data unit 118 enables to secure the overcharging time period in the overcharging period. To do this, the n/m compensation data unit 118 includes an n/m distribution unit 120 and a data compensation unit 122.

The n/m distribution unit 120 divides the 1/2 data enable signal 1/2DE from the 1/2 distribution unit 114 into n/m in return to generate the n/m data enable signal n/mDE, and outputs the n/m data enable signal n/mDE to the data compensation unit. That is, the data charging time period can be adjusted by using the n/m data enable signal n/mDE from the n/m distribution unit 120. Moreover, the n/m distribution unit 120 can divide the 1/2 data enable signal 1/2DE into n/m further. For an example, in a case of the liquid crystal display panel 100 having one frame frequency of 60 Hz, the n/m distribution unit 120 can generates the 1/4 data enable signal 1/4DE from the 1/2 data enable signal 1/2DE, and if the frequency is higher than 60 Hz, the frequency may be divided into 1/6, 1/8, - - - further, to generate data enable signals DE divided further.

Figure 5:
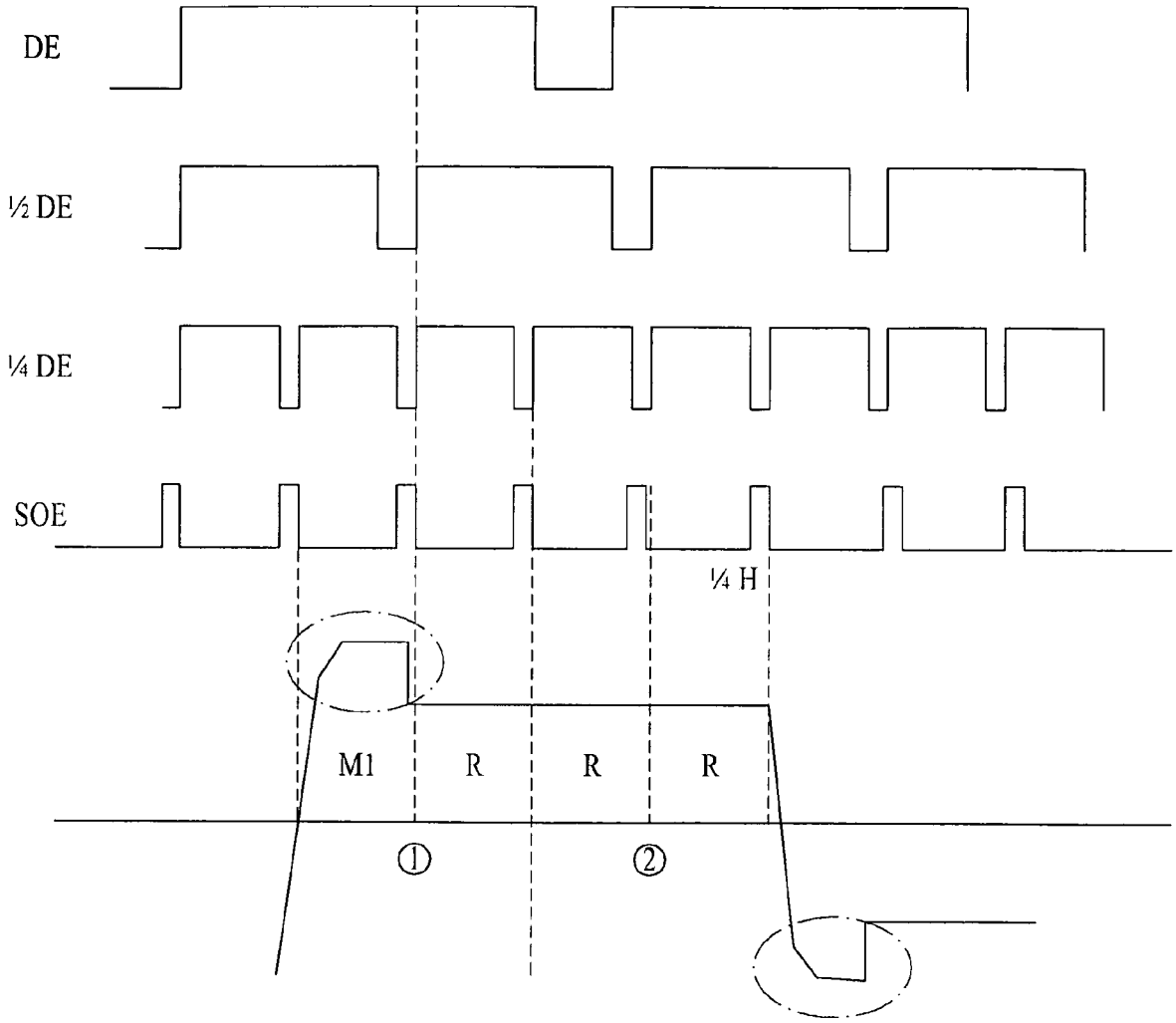
FIG. 5 illustrates driving waveforms in accordance with a first preferred embodiment of the present invention.

Thus, though the n/m distribution unit 120 can divides the data enable signal DE into n/m data enable signals n/mDE, 1/4 division of the data charging time period in two horizontal periods by generating the 1/4 data enable signal 1/4DE will be described. That is, as shown in FIG. 5, by the 1/4 data enable signal 1/4DE, the data charging period ① supplied in the first horizontal period is divided into first and second charging periods, and the data charging period ② supplied in the second horizontal period is divided into third and fourth charging periods.

The data compensation unit 122 generates at least one compensation data for compensating a data on one of periods of the first to fourth changing periods divided by the 1/4 data enable signal 1/4DE by gray scales or colors. That is, as shown in FIG. 5, the data compensation unit 122 generates a first compensation data M1 for compensating the first charging period of the data, modulates the data on the first charging period by using the first compensation data, and outputs the data modulated thus, and outputs an original data R in each of the second to fourth charging periods as it is. That is, the data compensating unit 122 generates a first compensation data having a gray scale higher than a gray scale of an original data in the first charging period which is the undercharging period ① for compensating the first charging period.

Figure 6:
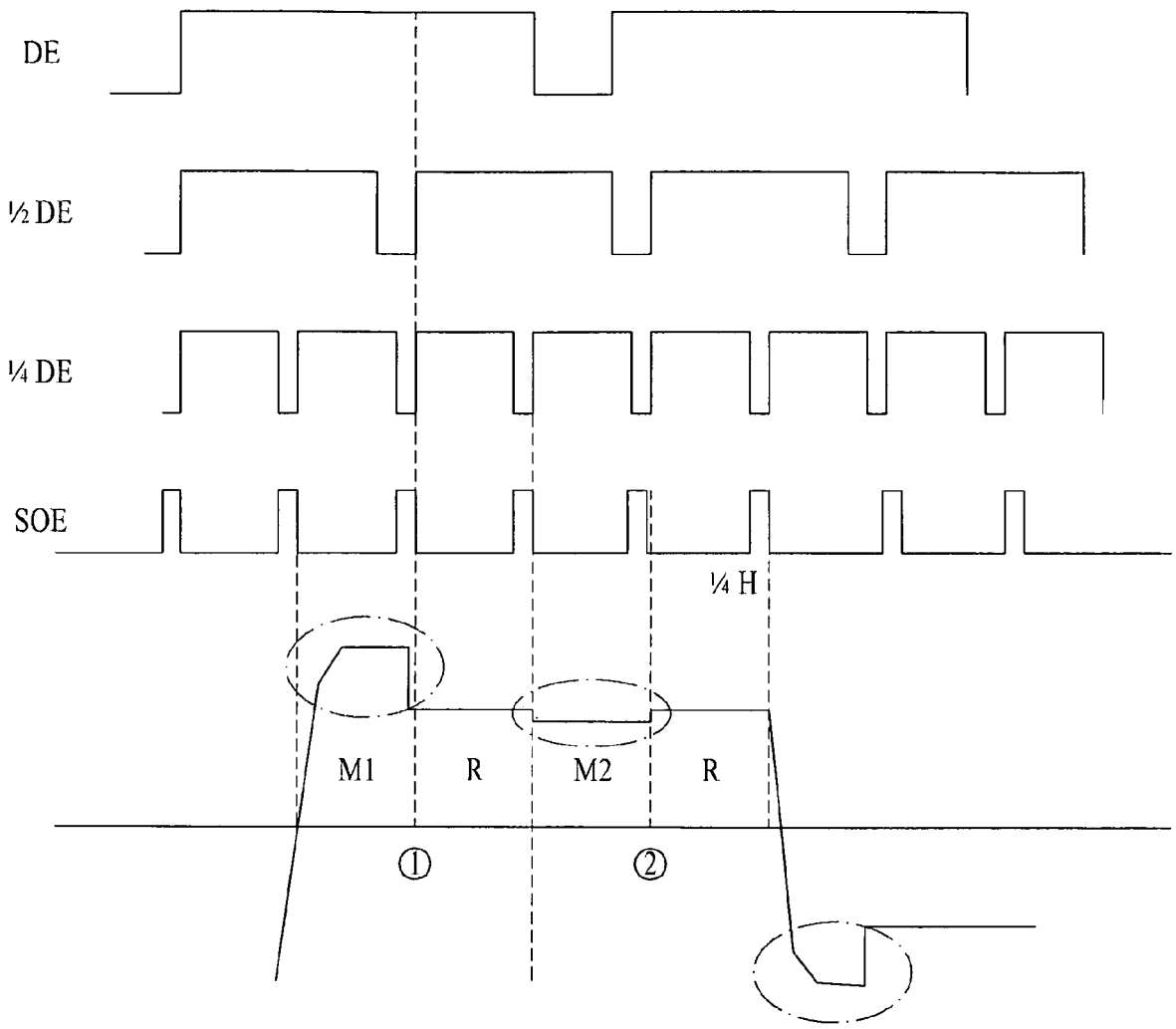
FIG. 6 illustrates driving waveforms in accordance with a second preferred embodiment of the present invention.

Moreover, referring to FIG. 6, the data compensating unit 122 generates the first compensation data M1 for compensating the first charging period of the data, modulates and outputs the data on the first charging period by using the first compensation data M1, generates the second compensation data M2 for compensating the third charging period of the data, modulates and outputs the data on the second charging period by using the second compensation data M2, and outputs an original data R in each of the second and fourth changing periods as it is. That is, the data compensating unit 122 generates a first compensation data having a gray scale higher than a gray scale of an original data in the first charging period which is the undercharging period ① for compensating the first charging period of the data, and generates a second compensation data M2 having a gray scale lower than a gray scale of an original data in the third charging period which is the overcharging period ② for compensating the third charging period of the data.

Figure 7:
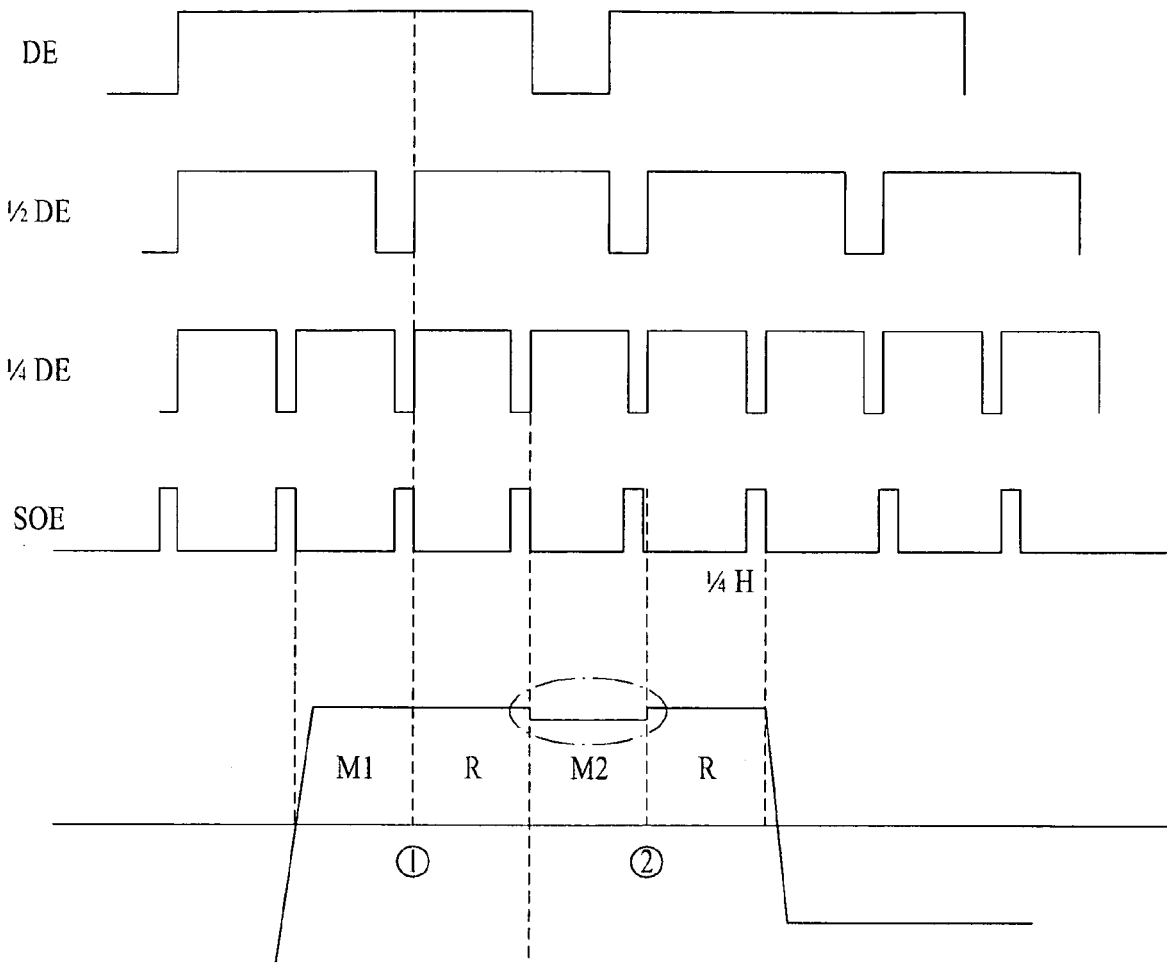
FIG. 7 illustrates driving waveforms in accordance with a third preferred embodiment of the present invention.

Also, referring to FIG. 7, the data compensating unit 122 generates the second compensation data M2 for compensating the third charging period of the data, and may output the original data R in each of the first, second, and third charging periods as it is. That is, the data compensation unit 122 generates a second compensation data M2 having a gray scale lower than a gray scale of an original data in the third charging period which is the overcharging period ② for compensating the third charging period of the data.

Referring to a block diagram in FIG. 4, to do this, the data compensation unit 122 includes a data selection unit 144, and a look-up table 146. As shown in FIG. 4, it will be described that the data compensation unit 122 generates the first compensation data M1 for compensating the first charging period, and outputs the original data R in the second and fourth charging periods, taking examples.

In detail, referring to FIG. 4, the data selection unit 144 outputs a compensation data, if any, to the look-up table 146, and outputs as it is, if there in no look-up data. That is, the data selection unit 144 outputs the first compensation data M1 on the first charging period to the look-up table 146, and outputs the data N on each of the second to fourth charging periods which have no compensation data as it is. According to this, the look-up table 146 outputs a modulated data N' corresponding to the first compensation data M1.

Only the first charging period can be compensated by above method, and one or two period of the first charging period and the second charging period can be compensated by above method.

The mini-LVDS transmitter 134 supplies the original data and the modulated data from the n/m compensation data unit 118 to the data driver 102 in a mode of the low voltage differential signal by a mini-LVDS system.

The timing controller logic unit 130 generates and supplies a plurality of data control signals DCS which control the data driver 102 and a plurality of gate control signals GCS which control the gate driver 104 by using the n/m data enable signal n/mDE from the n/m compensation data unit 118, and the dot clock DCLK which fixes a transmission frequency of the data, the horizontal synchronizing signal H, and the vertical synchronizing signal Vsync from the LVDS transmitter/receiver 110 and 112.

Figure 8:
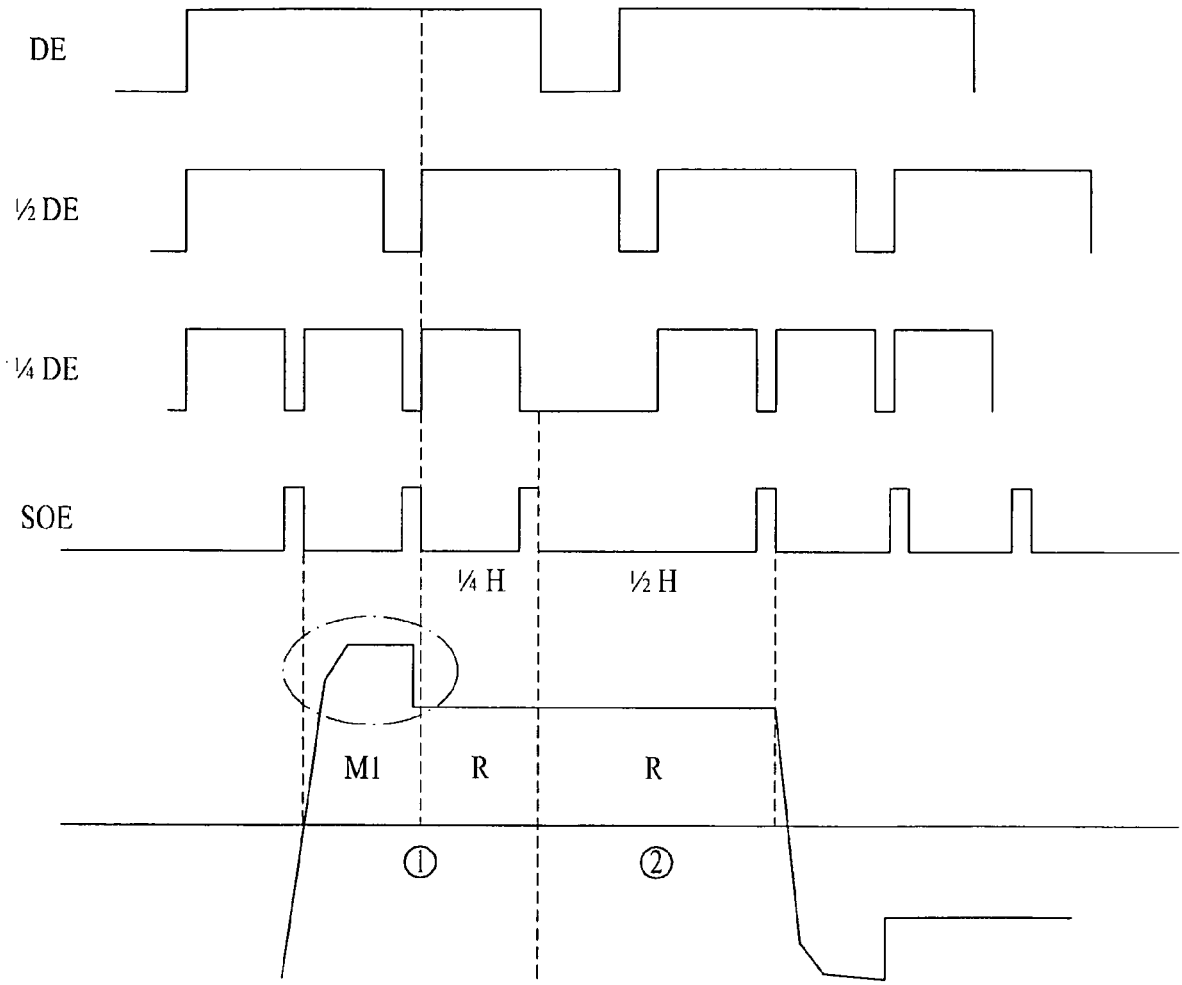
FIG. 8 illustrates driving waveforms in accordance with a fourth preferred embodiment of the present invention.

In the meantime, referring to FIG. 8, in a case the data is modulated only in the first charging period among the first to fourth charging periods, outputting the original data R in each of the second to fourth charging periods at it is, it is possible that the 1/2 data enable signal 1/2DE and the 1/4 data enable signal 1/4DE can be driven with the 1/2 data enable signal 1/2DE and the 1/4 data enable signal 1/4DE mixed.

The data driver 102 shifts a source start pulse SSP from the timing controller 150 in response to a source shift clock SSC, to generate the sampling signal. Also, the data driver 102 latches the pixel data R, G, B received according to the source shift clock SSC in response to the sampling signal, and supplies the pixel data R, G, B by a horizontal line thereof in response to the source output enable SOE signal. Then, the data driver 102 converts the pixel data R, G, B being supplied by a horizontal line thereof into an analog pixel signal by using a gamma voltage from a gamma generating unit (not shown), and supplies the analog pixel signal to the data lines DL1~DLm.

In this instance, the data driver 102 fixes a polarity of the pixel signal in response to a polarity control signal POL from the timing controller 150 at the time the data driver 102 converts the pixel data R, G, B into the pixel signal. The data driver 102 fixes a period in which the pixel signal is supplied to the data line DL1~DLm in response to the source enable SOE signal.

As has been described, the liquid crystal display device and a method for driving the same of the present invention have the following advantages.

The division of the data enable signal in a liquid crystal display panel into n/m to generate n/m data enable signals permits to a charge sharing period in an overcharging period by dividing a charging time period of a data into a plurality of charging time periods by using the n/m data enable signals. That is, by eliminating the charge sharing period in the overcharging period, an adequate charging time period can be secured.

Moreover, the elimination of the charge sharing period in the overcharging period permits to reduce power consumption.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

a liquid crystal display panel including first sub-pixels for charging a data of a polarity opposite to a prior horizontal period, and second sub-pixels for charging a data of a polarity identical to a prior horizontal period;

a data driver for driving a plurality of data lines of the liquid crystal display panel; and a timing controller for dividing a charging period of the data into a plurality of charging periods, generating at least one compensation data for compensating a data on at least one of the plurality of charging periods, and supplying the at least one compensation data to the data driver, wherein the timing controller generates a first compensation data having a gray scale higher than a gray scale of an original data only in one of a plurality of charging periods of only the first sub-pixels, and generates a second compensation data having a gray scale lower than a gray scale of an original data only in one of a plurality of charging periods of only the second sub-pixels.

2. The liquid crystal display device as claimed in claim 1, wherein the timing controller includes;

an 1/2 distribution unit for dividing a data enable signal received from an outside, to generate an 1/2 data enable signal; and an n/m compensation data unit for dividing the 1/2 data enable signal into n/m (where m is a natural numeral greater than n) to generate n/m data enable signals in return, dividing the charging time period of the data into a plurality of charging periods by using the n/m data enable signals, and generating the compensation data for compensating at least one of the plurality of charging periods.

3. The liquid crystal display device as claimed in claim 2, wherein the n/m compensation data unit divides the 1/2 data enable signal into n/m according to a frame frequency of the liquid crystal display.

4. The liquid crystal display device as claimed in claim 3, wherein m is a natural number greater than 2 when the liquid crystal display frame frequency is greater than or equal to 60 Hz.

5. The liquid crystal display device as claimed in claim 4, wherein n is 1 and m is 4 when the liquid crystal display frame frequency is equal to 60 Hz.

6. The liquid crystal display device as claimed in claim 2, wherein the n/m compensation data unit includes;

an n/m distribution unit for dividing the 1/2 data enable signal into n/m in return to generate a plurality of charging periods for generating n/m data enable signals, and a data compensation unit for generating at least one compensation data for compensating the data on one of the plurality of charging periods divided by the n/m data enable signal by gray scale or color.

7. The liquid crystal display device as claimed in claim 6, wherein the data compensation unit includes;

a data selection unit for determining whether a compensation data exists or not in the plurality of charging period, and a look-up table for outputting a modulated data corresponding to the compensation data if there is the compensation data, and outputting the data as it is if there is no compensation data.

8. A method for driving a liquid crystal display device comprising the steps of:

dividing a data enable signal received from an outside into 1/2;

dividing the 1/2 data enable signal into n/m (where m is a natural numeral greater than n) to generate n/m data enable signals in return, and dividing the charging time period of the data into a plurality of charging periods by using the n/m data enable signals; and generating at least one compensation data for compensating a data on at least one of the plurality of charging periods, wherein the generating at least one compensation data comprises generating a first compensation data having a gray scale higher than a gray scale of an original data only in one of a plurality of charging periods of only first sub-pixels, and generating a second compensation data having a gray scale lower than a gray scale of an original data only in one of a plurality of charging periods of only second sub-pixels, wherein the first sub-pixels charge a data of a polarity opposite to a prior horizontal period, and the second sub-pixels charge a data of a polarity identical to a prior horizontal period.

9. The method as claimed in claim 8, wherein the 1/2 data enable signal is divided into n/m according to a frame frequency of the liquid crystal display.

10. The method as claimed in claim 8, wherein the compensation data compensates a data by gray scale or color.

11. The method as claimed in claim 8, wherein the step of generating at least one compensation data for compensating a data on at least one of the plurality of charging periods includes the steps of;

determining whether a compensation data exists or not in the plurality of compensation periods, outputting a modulated data corresponding to the compensation data if there is the compensation data, and outputting the data as it is if there is no compensation data in the plurality of charging periods.

* * * * *